US006619169B1

(12) United States Patent
Wegener et al.

(10) Patent No.: US 6,619,169 B1
(45) Date of Patent: Sep. 16, 2003

(54) SYSTEM FOR PUNCHING METAL SHEETS AND FOR STACKING METAL SHEETS IN THE APPROPRIATE PUNCHED PATTERN

(75) Inventors: Konrad Wegener, Goeppingen (DE); Alfred Bareis, Uhingen (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/419,080

(22) Filed: Oct. 15, 1999

(30) Foreign Application Priority Data

Oct. 15, 1998 (DE) ..... 198 47 551

(51) Int. Cl.[7] ..... B26D 7/06; B30B 15/32; B26F 1/00

(52) U.S. Cl. ..... 83/90; 83/149; 83/157; 83/162; 83/167; 83/465; 83/685; 29/596

(58) Field of Search ..... 83/27, 55, 81, 83/89, 90, 91, 92, 92.1, 94, 102, 162, 167, 452, 454, 465, 684, 685, 147, 149, 163, 166, 97; 29/598, 564.2, 596, 732, 736, 738, 564.6

(56) References Cited

U.S. PATENT DOCUMENTS

| | | | | | |
|---|---|---|---|---|---|
| 514,239 | A | * | 2/1894 | Moonelis | 271/217 |
| 1,618,453 | A | * | 2/1927 | Lighter | 29/DIG. 26 |
| 1,865,947 | A | * | 7/1932 | Novick | 83/588 |
| 2,220,056 | A | * | 10/1940 | Donnerberg et al. | 269/303 |
| 2,258,070 | A | * | 10/1941 | Sawle | 83/97 |
| 2,483,735 | A | * | 10/1949 | Noell | 269/111 |
| 3,546,990 | A | * | 12/1970 | Schneider | 83/27 |
| 4,108,031 | A | * | 8/1978 | Dangelmaier et al. | 83/90 |
| 4,110,895 | A | * | 9/1978 | Mitsui | 29/564.2 |
| 4,197,772 | A | * | 4/1980 | Anderson et al. | 83/63 |
| 4,392,906 | A | * | 7/1983 | Hara | 156/250 |
| 4,445,272 | A | * | 5/1984 | Bruhn et al. | 29/564.2 |
| 4,509,396 | A | * | 4/1985 | Schall et al. | 83/126 |
| 4,716,800 | A | * | 1/1988 | Bareis et al. | 83/91 |
| 4,982,635 | A | * | 1/1991 | Thatcher | 83/149 |
| 5,171,962 | A | * | 12/1992 | Sakanishi | 219/121.64 |
| 5,183,247 | A | * | 2/1993 | Blumer | 270/95 |
| 5,249,492 | A | * | 10/1993 | Brown et al. | 414/790.6 |
| 5,695,591 | A | | 12/1997 | Hamada et al. | |
| 5,768,963 | A | * | 6/1998 | Bruchwiler | 83/27 |
| 6,324,951 | B1 | * | 12/2001 | Wegener | 83/102 |

FOREIGN PATENT DOCUMENTS

| | | | |
|---|---|---|---|
| DE | 2630867 | A1 * | 1/1978 |
| DE | 2706274 | A1 * | 8/1978 |
| EP | 0446714 | | 12/1998 |
| FR | 2289267 | | 5/1976 |

* cited by examiner

*Primary Examiner*—Boyer D Ashley
(74) *Attorney, Agent, or Firm*—Crowell & Moring LLP

(57) ABSTRACT

A system for punching metal sheets and for stacking metal sheets in the appropriate punched pattern, particularly for electric machines, has a die for punching the metal sheets, a die plate cooperating with the die, and a guiding device for guiding the punched metal sheets below the die plate. The guiding device has at least two clamping elements. The clamping elements are provided for clamping the punched metal sheets on their circumference and thus forming a stack branch-off which permits an uninterrupted punching during the discharge of the metal sheet stack.

13 Claims, 2 Drawing Sheets

SYSTEM FOR PUNCHING METAL SHEETS AND FOR STACKING METAL SHEETS IN THE APPROPRIATE PUNCHED PATTERN

BACKGROUND OF THE INVENTION

This application claims the priority of 198 47 551.9, filed Oct. 15, 1998, the disclosure of which is expressly incorporated by reference herein.

The present invention relates to a system for punching metal sheets and for stacking metal sheets in the appropriate punched pattern, and more particularly, to a system having a die for punching the metal sheets, a die plate cooperating with the die, a guiding device for guiding the punched metal sheets below the die plate.

A known system of the general type is described in DE 26 05 983 C3. The punched metal sheets are stacked or guided onto a mandrel which is situated in the receiving shaft for the metal sheets below the die and which receives the metal sheets on their interior bore. A relatively large interior bore of the metal sheets is disadvantageously required, however, because, with the otherwise required small diameter, the stacking mandrel will become very unstable. Furthermore, for the retooling to metal sheets of a different inside diameter, the stacking mandrels must be exchanged. This exchange cannot be automated and is, therefore, very time and cost intensive.

Concerning the general state of the art with respect to punching metal sheets and stacking metal sheets in an appropriate punched pattern, reference is also made to DE 31 47 034 A1; DE 28 39 928 A1; EP 0 343 661 A1; DE 26 30 867 C2; DE 20 65 645 A1; DE 27 06 274 A1; DE 23 39 322 A1; and DE 26 19 127 A1.

SUMMARY OF THE INVENTION

An object of the present invention is to provide a system for stacking metal sheets in an appropriate punched pattern which ensures a very good guiding of the punched sheets and which, when the production is retooled to another diameter of the metal sheets, can be adapted very rapidly, particularly without requiring any retooling work.

According to the invention, this object has been achieved by providing that the guiding device has at least two clamping elements, and the clamping elements are provided for clamping the punched metal sheets on their circumference.

By way of the clamping elements according to the invention which are applied to the circumference of the metal sheets and are thus capable of clamping-in these metal sheets, an exterior guiding is obtained for the metal sheets which can be adapted in a very simple manner to different diameters of the metal sheets.

In this case, the lowest metal sheet situated in the guiding device between the clamping elements in a simple manner forms the separation between those metal sheets which are intended for the further transport or a further machining and are therefore already situated below the guiding device and those metal sheets which are to be stacked by the guiding device. Thus, a stack branch-off is formed by the clamping elements so that, also during a discharge of the metal sheets, an uninterrupted punching of the metal sheets can take place. Furthermore, a twisting of the metal sheets by the clamping elements according to invention can be prevented.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
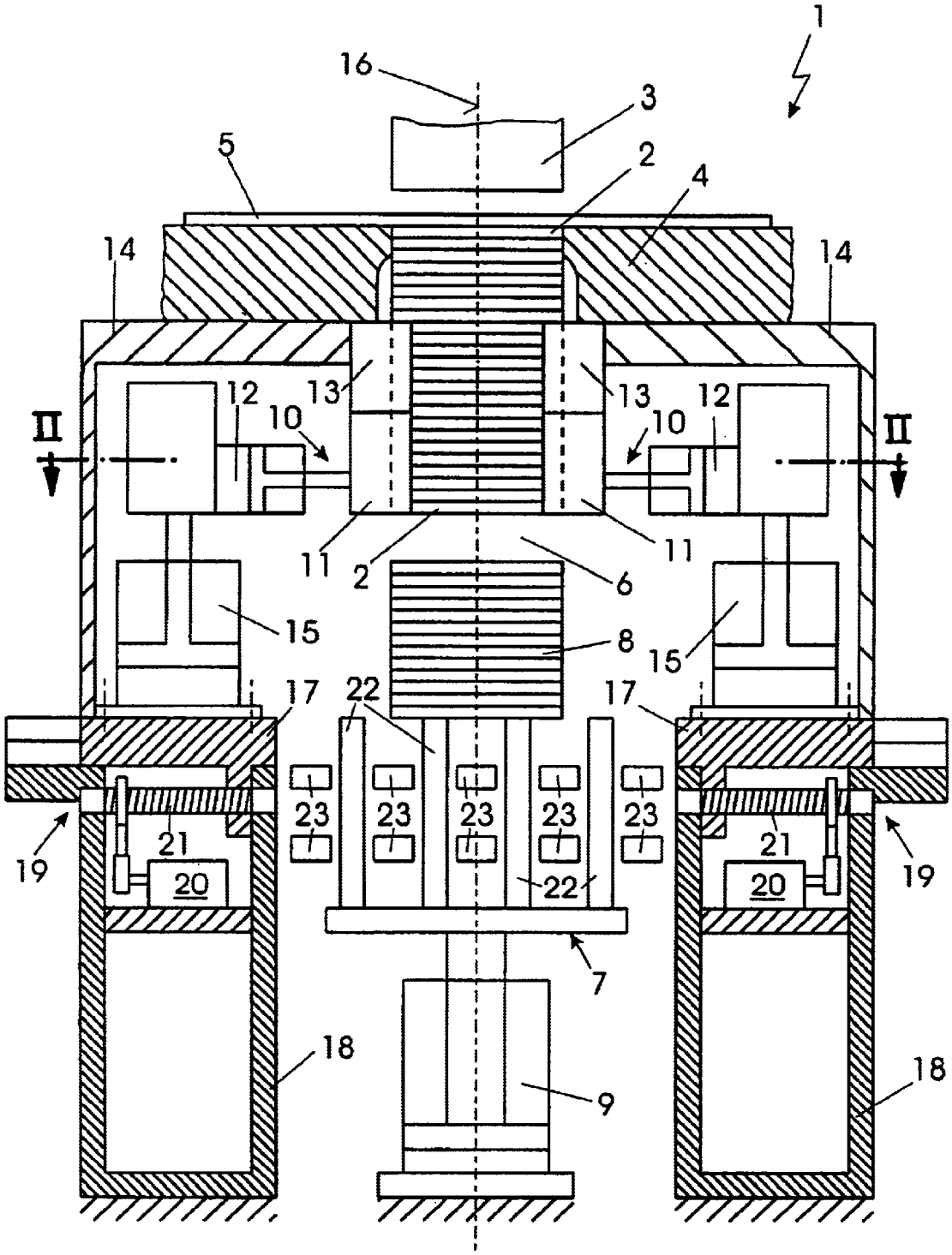
FIG. 1 is a sectional elevational view of a system according to the invention for stacking metal sheets in the appropriate punched pattern.

FIG. 1 illustrates a system 1 for punching preferably round metal sheets 2 and for stacking preferably round metal sheets 2 which are produced by a tool top part or die 3 and a tool bottom part or die plate 4 which cooperates with the die 3 from a sheet metal strip 5 in a manner generally known per se. Of course, punched metal sheets of other than round geometry can also be produced.

Below the die plate 4, a receiving shaft 6 is situated into which the punched metal sheets 2 drop and are stacked onto a supporting element 7 in the form of a metal sheet stack 8 which is situated at the lower end of the receiving shaft 6. On its bottom side, the supporting element 7 has a stroke device 9 (in this embodiment, a pneumatic or hydraulic cylinder/piston unit) which is capable of moving the supporting element 7 downward during the punching of the metal sheets 2. In this manner, new metal sheets 2 are ensured to be continuously punched and arrive in the receiving shaft 6. As required, the stroke device 9 can also displace the supporting element 7 upward again. For this purpose, the stroke device 9 can be connected with a control of the die 3 in a manner not shown. As an alternative, the stroke device 9 may also be constructed as an electric stroke device 9 or as a linear drive. In this context, the stroke device 9 can be coupled with the die 3 such that, during each stroke of the die 3, the supporting element 7 is moved downward by the thickness of one punched sheet 2.

Directly below the receiving shaft 6, a guiding device 10 is situated for guiding the metal sheets 2. The guiding device 10 has two mutually opposite clamping elements 11 which act upon the circumference of the metal sheets 2 and which have a prism-shaped construction on their side facing the metal sheets 2. On their side facing away from the metal sheets 2, the clamping elements 11 are connected with a driving device 12 which is capable of moving the clamping elements 11 perpendicularly to the punching direction toward and away from the metal sheets 2. In the illustrated embodiment, the driving device 12 is a pneumatic or hydraulic cylinder/piston unit but, as required, may also be formed by an electric drive.

Figure 2:
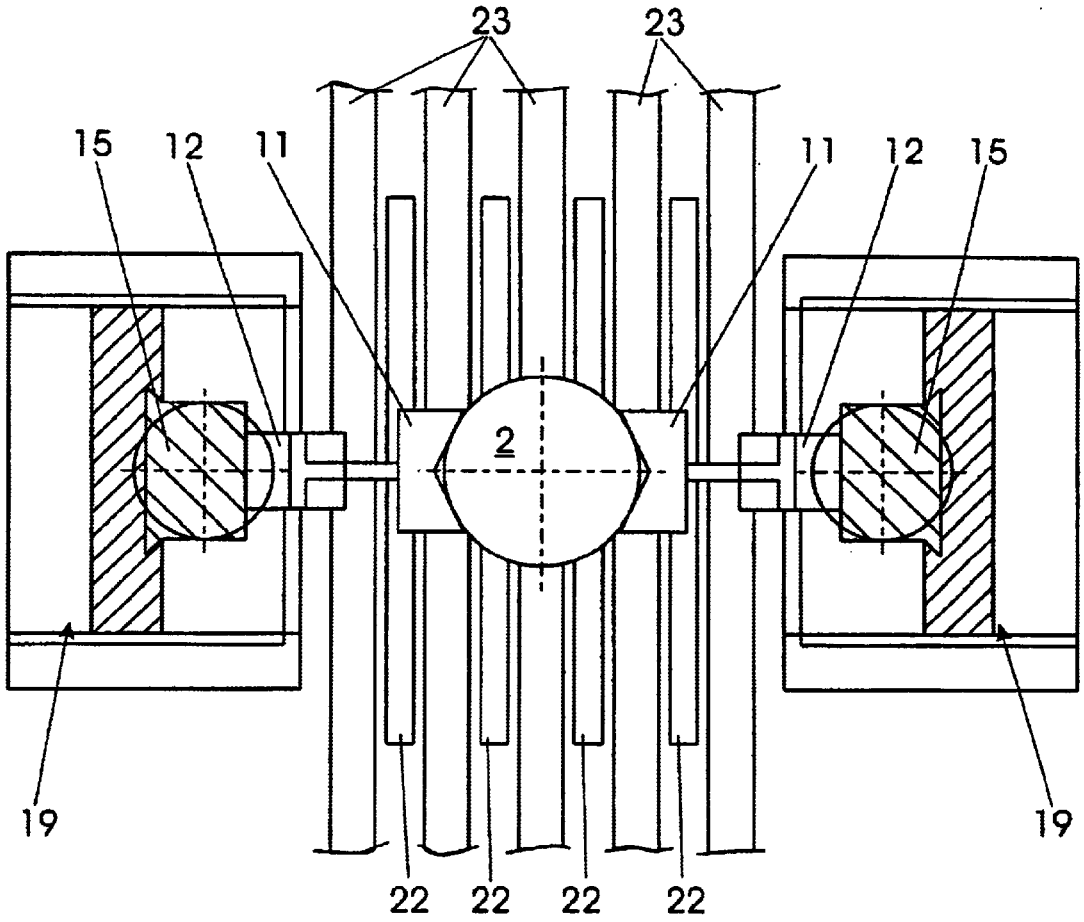
FIG. 2 is a plan view of a section along line II—II of FIG. 1.

Guiding elements 13 are connected with a fastening element 14 directly below the tool bottom part 4 and are situated above the clamping elements 11. The guiding elements 13 also have a prism-shaped construction, as illustrated in FIG. 2. The punched metal sheets 2 leaving the die plate 4 are therefore guided between the guiding elements 13 before they arrive in the area of the clamping elements 11. This prevents the displacement of the metal sheets 2. The twisting of the metal sheets 2 is prevented in that the metal sheet stack a is clamped in under an axial pressure between the shell of the die plate 4 and the stroke device 9 and the clamping elements 11. This permits a stacking of the punched metal sheets in the appropriate punched pattern.

The entire guiding device 10, i.e., the clamping elements 11 with the driving device 12, can be height-wise adjusted by another driving device 15 in the perpendicular direction, i.e., in the direction of a longitudinal axis 16 of the receiving shaft 6 or in the punching direction. The longitudinal axis 16 therefore also forms the longitudinal axis of the die 3. In the present case, the driving devices 12, 15 are each constructed as cylinder/piston units of a hydraulic or pneumatic nature but may optionally be replaced by electric drives. The driving devices 15 are each situated on a carriage 17 which is disposed on a frame 18 which is part of the system 1.

In order to be able to adapt the guiding device 10 to various diameters of metal sheets 2, a diameter adjusting device 19 is arranged in a respective mutually opposite manner between the driving device 15 and the frame 18. A spindle 21 can be moved by way of a driving device 20, whereby the carriage 17 is adjusted perpendicularly to the longitudinal axis 16. In addition to the driving device 15, the fastening element 14 is also mounted on the carriage 17. Therefore, when the carriage 17 is moved, the entire guiding system 10, together with the clamping elements 11 and the guiding elements 13, are moved in the direction of the metal sheets 2 or away from the metal sheets 2 and are therefore adjusted to their diameter. In this case, the driving device 20 can have an electric, hydraulic, pneumatic or any other construction, the spindle 21 not being absolutely necessary.

FIG. 1 also shows that the supporting element 7 is constructed in a rake shape with tines 22 which extend in the direction of the longitudinal axis 16 of the receiving shaft 6. The punched metal sheets 2 are deposited as metal sheet stacks 8 on the tines 22. Conveying chains 23 for transporting the metal sheet stacks 8 extend between the tines 22 perpendicularly thereto and perpendicularly to the longitudinal axis 16. When the supporting element 7 is moved downward by the stroke device 9, the corresponding metal sheet stack 8 comes to rest against a defined point on the conveying chains 23 and is moved away from its position below the receiving shaft 6. FIG. 2 also illustrates the conveying chains 23 which extend between the guiding device 10 and there between the tines 22 as well as outside the latter.

When producing punched metal sheets 2 by means of the die 3, the punched metal sheets 2 are first stacked on the supporting element 7. When a preselected height of the metal sheet stack 8 has been reached, the clamping elements 11 will engage and hold the lower punched sheets 2 of the metal sheet stack 8. The supporting element 7 then moves downward and deposits the separated punched sheets 2 on the conveying chain 23. During this operation, the punching of the metal sheets 2 continues, whereby the punched metal sheets 2 are caught by the lowest punched metal sheet 2 situated between the guiding elements 13. In other words, when branching off a defined quantity of punched metal sheets 2 from the metal sheet stack 8, the separation of the branched-off metal sheets 2 from the remaining metal sheets 2 is formed by the lowest metal sheet 2 which is still situated between the guiding elements 13 and which therefore represents a stack branch-off.

After depositing of the branched-off metal sheets 2 on the conveying chains 23 and their removal from the area of the supporting element 7, the latter is lifted to below the clamping elements 11, whereupon the clamping elements 11 are withdrawn. During the punching operation, the supporting element 7 moves outside the depositing operation by one metal sheet thickness per stroke downward. During the interventions of the clamping elements 11, the remaining metal sheets 2 move by one metal sheet thickness per stroke downward by way of the stroke device 9. Optionally, the stroke of the die 3 may be utilized for achieving the step-by-step lowering of the punched metal sheets 2.

After the removal via the conveying chains 23, the punched sheets 2 may be welded together or machined in a different manner. This additional processing can, however, already be provided before the deposition of the punched sheets 2. A welding-together of the punched sheets 2 may be meaningful or necessary, for example, if they are to be used for manufacturing rotors or stators of electric motors.

Figure 3:
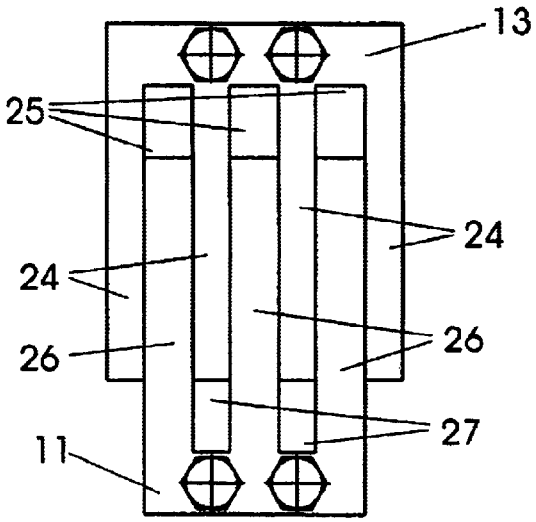
FIG. 3 is a front view of the clamping element according to the invention as part of the guiding device.

FIG. 3, which shows the clamping elements 11 and the guiding elements 13 from the direction of the longitudinal axis 16, illustrates the construction of the clamping elements 11 and of the guiding elements 13. Specifically, the guiding elements 13 are constructed in a rake shape with tines 24 and with clearances 25 situated between the tines 24. The clamping elements 11 also have tines 26 and clearances 27 formed between the tines 26. The two elements 11, 13 are arranged such that the tines 24 of the guiding elements 13 engage in the clearances 27 of the clamping elements 11, and the tines 26 of the clamping elements 11 engage in the clearances 25 of the guiding elements 13. The clearances 25, 27 are approximately as wide as the tines 24, 26 SO that a guiding of the punched metal sheets 2 takes place by way of the guiding elements 13 and the clamping elements 11.

The rake-shaped construction of the clamping elements 11 and of the guiding elements 13 ensures a good guidance and a corresponding clamping effect for the punched metal sheets 2 along a very long length in the direction of the longitudinal axis 16. Also, as a result, a horizontal gap can be avoided between the clamping elements 11 and the guiding elements 13 which prevents that punched metal sheets 2 can move to the outside through the clamping elements 11 and the guiding elements 13.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A system for punching metal sheets and for stacking metal sheets in an appropriate punched pattern, comprising a die configured and arranged to punch the metal sheets individually arranged on a stack, a die plate operatively cooperating with the die, a supporting element arranged below the die plate, a guiding device configured to guide the metal sheets that have been individually punched below the die plate into the stack and onto the supporting element, and means arranged on opposite sides of the stack for adjusting the guiding device to accommodate stacks of different diameter, wherein, the guiding device has at least two clamping elements adjacent the die plate and spaced from the supporting element on opposite sides of the stack, the clamping elements being configured and arranged to clamp a circumferential portion of the punched metal sheets and to move together with said adjusting means for accommodating the stacks of different diameter.

2. The system according to claim 1, wherein the guiding device includes a respective driving device for adjusting the clamping elements perpendicularly to a punching direction.

3. The system according to claim 1, wherein the guiding device is configured to be vertically adjustable by a driving device in a direction of a longitudinal axis of the die.

4. The system according to claim 1, wherein the supporting element has a rake-shaped configuration between tines extending in a direction of a longitudinal axis of the die.

5. The system according to claim 4, wherein conveying chains are operatively arranged between the tines of the supporting element to transport metal sheet stacks.

6. The system according to claim 1, wherein the guiding device includes guiding elements arranged between the clamping elements and the die plate.

7. The system according to claim 6, wherein the clamping elements and the guiding elements have a rake-shaped configuration with mutually cooperating tines aligned in a direction of a longitudinal axis of the die.

8. The system according to claim 1, wherein the supporting element is configured to be vertically adjustable by a stroke device.

9. The system according to claim 8, wherein the supporting element has a rake-shaped configuration between tines extending in a direction of a longitudinal axis of the die.

10. The system according to claim 9, wherein conveying chains are operatively arranged between the tines of the supporting element to transport metal sheet stacks.

11. The system according to claim 8, wherein the guiding device includes a respective driving device for adjusting the clamping elements perpendicularly to a punching direction.

12. The system according to claim 11, wherein the guiding device includes guiding elements arranged on a side of the clamping elements facing away from the die plate.

13. The system according to claim 12, wherein the clamping elements and the guiding elements have a rake-shaped configuration with mutually cooperating tines aligned in a direction of a longitudinal axis of the die.

* * * * *